US011214417B2

(12) United States Patent
Covi

(10) Patent No.: US 11,214,417 B2
(45) Date of Patent: Jan. 4, 2022

(54) VALVE ASSEMBLY FOR A BEVERAGE CONTAINER

(71) Applicant: Emanuela Covi, Merano (IT)

(72) Inventor: Emanuela Covi, Merano (IT)

( * ) Notice: Subject to any disclaimer, the term of this patent is extended or adjusted under 35 U.S.C. 154(b) by 0 days.

(21) Appl. No.: 17/051,041

(22) PCT Filed: Apr. 29, 2019

(86) PCT No.: PCT/IT2019/050085

§ 371 (c)(1),
(2) Date: Oct. 27, 2020

(87) PCT Pub. No.: WO2019/207614

PCT Pub. Date: Oct. 31, 2019

(65) Prior Publication Data

US 2021/0122536 A1 Apr. 29, 2021

(30) Foreign Application Priority Data

Apr. 27, 2018 (IT) ..... IT102018000004915
Apr. 23, 2019 (IT) ..... IT102019000006266

(51) Int. Cl.
*B65D 47/24* (2006.01)
*B65D 53/02* (2006.01)
*B67D 1/08* (2006.01)

(52) U.S. Cl.
CPC ..... *B65D 47/248* (2013.01); *B65D 53/02* (2013.01); *B67D 1/0832* (2013.01)

(58) Field of Classification Search
CPC ..... B65D 47/248; B65D 53/02; B67D 1/0832
USPC ..... 222/400.7, 551, 562, 541.1, 541.7
See application file for complete search history.

(56) References Cited

U.S. PATENT DOCUMENTS 1,424,243 A * 8/1922 Fox ..... B65D 47/263 222/551
2,661,128 A * 12/1953 Rieke ..... B65D 47/10 222/529
2,932,436 A * 4/1960 Dobbins ..... B65D 47/123 222/541.1
3,223,298 A * 12/1965 Roberson ..... B65D 47/10 222/541.6
3,977,569 A * 8/1976 Scholle ..... B65D 11/06 222/105

(Continued)

FOREIGN PATENT DOCUMENTS

GB 2481465 A 12/2011
WO 201101804 A1 2/2011
WO 2018225109 A1 12/2018

OTHER PUBLICATIONS

International Search Report and Written Opinion from PCT/IT2019/050085 dated Aug. 29, 2019 (9 pages).

*Primary Examiner* — Paul R Durand
*Assistant Examiner* — Michael J. Melaragno
(74) *Attorney, Agent, or Firm* — Calfee Halter & Griswold LLP

(57) ABSTRACT

A valve assembly for a beverages container with two components, of which one external container and one internal container, closed at the upper part by a closing device, comprises a valve body made in a single body and a spring device, wherein a mobile sealing unit is present between the valve body and the spring device, configured to selectively open and close a passage aperture of the valve assembly.

20 Claims, 5 Drawing Sheets

(56) References Cited

U.S. PATENT DOCUMENTS 4,000,839 A * 1/1977 Tecco ..... B65D 50/067 222/540
4,142,658 A * 3/1979 Golding ..... B67D 1/0832 137/212
4,181,143 A * 1/1980 Fallon ..... B67D 1/0832 137/212
4,265,374 A * 5/1981 Sebalos ..... B65D 83/62 222/105
4,411,287 A * 10/1983 Hyde ..... B67D 1/0832 137/212
4,509,663 A * 4/1985 Fallon ..... B67D 1/0832 137/212
4,671,436 A * 6/1987 Hagan ..... B67D 1/0456 215/4
4,694,975 A * 9/1987 Hagan ..... B67D 1/0456 215/4
4,773,571 A * 9/1988 Hagan ..... B67D 1/0456 222/394
5,046,645 A * 9/1991 Hagan ..... B65D 83/48 222/394
5,102,010 A * 4/1992 Osgar ..... B65D 47/36 222/1
5,615,801 A * 4/1997 Schroeder ..... B67D 1/0021 222/51
5,836,364 A * 11/1998 Burton ..... B65B 31/047 141/348
6,202,717 B1 * 3/2001 Markey ..... B67D 7/0294 141/311 R
6,367,660 B1 * 4/2002 Chang ..... B67D 1/0838 137/212
7,708,025 B2 * 5/2010 Johnson ..... F16K 27/0209 137/316
2006/0043056 A1 * 3/2006 Lee ..... B65D 77/28 215/344
2009/0184133 A1 * 7/2009 Hasegawa ..... B67D 7/0261 222/95
2010/0018994 A1 * 1/2010 Antheil ..... B65D 21/0231 222/105
2010/0116356 A1 * 5/2010 Wauters ..... B67D 1/0832 137/317
2011/0049191 A1 * 3/2011 Crawford ..... B05B 15/30 222/382
2013/0192691 A1 * 8/2013 Smith ..... B67D 1/0835 137/320
2016/0288967 A1 * 10/2016 Isogai ..... B65D 47/36

* cited by examiner

VALVE ASSEMBLY FOR A BEVERAGE CONTAINER

CROSS-REFERENCE TO RELATED APPLICATIONS

This application is a 371 of PCT Application No. PCT/IT2019/050085 filed on Apr. 29, 2019, which claims priority to Italian Application No. 102018000004915 filed on Apr. 27, 2018, and Italian Application No. 102019000006266 filed on Apr. 23, 2019, the contents of which are hereby incorporated by reference as if recited in their entirety.

FIELD OF THE INVENTION

The present invention concerns a valve body and a connected valve assembly that can be used in beverage containers and associated with dispensing devices.

Advantageously, the beverage containers which the valve assembly can be used in are keg type containers with two coaxial bodies, of which an external container, or drum, has a support and protection function, and an internal container, or bag, is used to contain the beverage The removal of the beverage can occur, depending on how the two containers are made, either by pressing on the external container or by introducing a gas, for example pressurized air, between the external and the internal container.

The present invention preferentially, though not exclusively, concerns containers which allow to remove the beverages by introducing gaseous fluid between the two coaxial containers.

BACKGROUND OF THE INVENTION

In the state of the art, valve assemblies to control and regulate a flow of fluid are known. Their use is widespread in various sectors and in numerous applications where it is necessary to selectively allow and prevent the passage of the fluid under certain conditions of use.

Containers for fluids, in particular for beverages, are also known comprising valve assemblies and closing devices which allow the beverage to exit during a dispensing step and allow to close the container when the dispensing of the drink is not required.

Examples of valve assemblies and closing devices are known, for example, from GB-A-2481465, WO-A-2011/012804 and WO-A-2018/225109.

These valve assemblies have a plurality of disadvantages.

One disadvantage is that, at the end of the cycle of the container, the valve assembly has to be broken down into its components in order to be recycled, as at least one of them is a metal component.

Furthermore, in practice the various components are often not made with compatible plastics.

Another disadvantage is caused by the fact that known valve assemblies are complex and excessively articulated, so that they do not allow for easy and quick cleaning, nor simple interventions for possible replacement of components.

A further disadvantage is determined by the fact that the operations of installing known valve assemblies on the container, fine tuning and starting them up, are not always easy, given their complexity and articulation.

A further disadvantage is that the hydraulic seal is not always optimal, and is not always such as to last as long as the life of the container; also, the seal is not always uniform along the periphery of the valve assembly.

A further disadvantage is that known valve assemblies do not allow the excess gas to be discharged from the container simply and automatically after the dispensing devices have been removed, with consequent safety risks for operators who have to handle containers with pressurized gas.

In known solutions, furthermore, there can be the danger of mold forming if beer stagnates, even in small quantities, in the valve assembly, or between the latter and the closing stopper.

One purpose of the present invention is to provide a valve body and a connected valve assembly which overcome at least some of the disadvantages of the state of the art.

Another purpose of the invention is to provide a valve body which is easy to produce, and which guarantees the desired hermetic seal of the container with which it is associated.

Another purpose is to provide a valve assembly which is simple and has a reduced number of components with respect to known valve assemblies, so as to reduce production costs, the energy consumed to produce them, the spaces required to store them, assembly times, and the recycling times and costs.

A further purpose is the simplicity and ease of sanitizing the components before their assembly, and in the case of disassembly for cleaning or replacement of a component.

A purpose is also to improve the removal of excess air between the two containers, if the beverage is dispensed by introducing air, or gas, between the two containers.

A further purpose is also to improve the functioning of the operations to fill and close the container.

A further purpose is to improve the functioning at least of the beverage tapping operations, obtaining a flow that is as constant and uniform as possible.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

The present invention concerns a valve assembly, intended at least to remove a beverage contained in the internal container of a two-component container, and to introduce a pressurized fluid into the hollow space between the two containers.

These valve assemblies have to meet multiple requirements.

They have to be simple, easy to use, and suitable to cooperate with devices for dispensing/introducing a beverage both during the tapping step, and also possibly during the step of loading the beverage itself. Furthermore, these valve assemblies have to guarantee the hermetic seal of the container for the entire life-cycle of the container or of the beverage inside it; they must also provide the possibility of storage times of a few months between the loading of the beverage and the end of the tapping.

In the case of valve assemblies according to the invention, which are used for tapping by acting in the hollow space, the valve assembly has to also allow the certain and complete expulsion of possible excess gas that is introduced between the two containers for tapping.

The invention protects an advanced valve assembly which allows all the operations identified above, and in addition:

allows the sanitization of the components before they are assembled, facilitating cleaning and maintenance operations;

allows easy operations during the assembly step, as well as during intervention in the event that, for whatever reason, the valve assembly, or other, malfunctions;

guarantees the correct and autonomous injection of the tapping gas, such as for example air, and the discharge without delay or setbacks of the excess gas from the hollow space when the dispensing devices are removed;

allows all the components to be easily recycled, even in a single body, without any additional dismantling operations of parts thereof;

it is very simple and consists of very few pieces, such as a spring device and a valve body substantially in a single piece, and therefore greatly reduces costs, warehouse stocks, waste, the spaces occupied and the energy to obtain the whole thing, and it is such that it can be recycled even without being disassembled;

allows various types of elastic elements operating on the closure of the valve assembly and ensures that the closure of the valve assembly is uniform and certain along the entire circumference of the valve assembly.

These and other and further advantages will become apparent from the following description.

According to the invention, in its minimal embodiment, the valve assembly consists of two components: a valve body and a spring device.

The components, in the embodiment described here, are provided consisting of two distinct elements which are then assembled.

According to one embodiment, the valve body comprises a single body complete with gaskets and a seating, in this case female, of a mobile sealing unit, as well as means to contain the spring device.

In certain situations, a variant can be used in which the containing means of the spring device are made partly on the valve body and partly on a support element which is associated therewith in order to provide a more stable support for the spring device.

The lower body or support element can be made to anchor on the valve body in snap-in manner or by means of another type of connection.

According to this variant embodiment, in which the valve body and the support body are made as distinct elements coupled to one another, the valve assembly consists of three components.

The support element contains and positions the spring device which acts on the valve body, and the conformation in one or two bodies of the valve body defines the way in which the spring device is anchored to withstand its axial stresses.

If the valve body is in a single piece with the containing means, without the need for the support element, the spring device anchors elastically, for example, to a suitable recess inside the valve body.

If the valve assembly also has the support element, the spring device can rest on the base of the removable support element.

According to other embodiments, in an embodiment suitable for sanitization, at least part of the element which contains the spring device has longitudinal fissures which allow the rays or the sanitizing material to penetrate inside said element, guaranteeing the desired result.

In its normal embodiment, the valve body cooperates with the fixed means for closing the apertures of the two coaxial containers and includes in itself a component of a mobile sealing unit suitable to selectively allow the passage of at least one fluid through it. The mobile sealing unit allows the cooperation of the spring device with the valve body.

The valve body, according to the invention, includes in itself both the seating of a female component of the mobile sealing unit, and also a sealing gasket which cooperates in the hydraulic seal of the valve assembly as a whole.

The female seating of the mobile sealing unit has, advantageously, a truncated cone shape, and cooperates with a male component which also has a truncated cone shape mating with the female seating.

According to a variant, the body of the valve in relation to the loading mouth initially has closing and control means substantially coaxial to the valve assembly.

The closing and control means, when the dispensing device is first inserted, disconnect from the valve body, integrating with the male component of the mobile sealing unit, so as to move integrally with the latter when subjected to the action of the spring device and/or the dispensing devices.

According to some embodiments, the valve body has a rigid body which forms the female seating, as well as the portions that connect with the upper edges of the components of the container with which it can be associated, and a lower extension which penetrates inside the internal container.

According to some embodiments, at the same time the valve body has, in a single body, a soft material which forms at least two hydraulic seals, or gaskets.

According to some embodiments, the soft material, acting as a gasket, operates toward an upper circumferential internal surface of the internal container.

According to a variant, the soft material also operates toward a perimetral extension of the female component of the mobile sealing unit thus ensuring, with the male component, a certain and lasting seal even in the presence of strong external disturbing factors.

According to a variant, the upper part of the valve body has an upper gasket which cooperates with the upper part of the two containers, guaranteeing the hydraulic seal.

According to a further variant, the rigid body is integrally connected to at least the gasket which clamps the upper end part of the two containers.

According to a further variant, the rigid body is integrally connected at least also to the gasket which assists the female seating of the mobile sealing unit.

According to the invention, advantageously, the male component of the mobile sealing unit, in addition to the male component, has a coordinated second seal annular seating which cooperates with the gasket which assists the female seating.

According to another variant, this gasket is integral with the male component.

According to the invention, the valve body can be made according to two different methods, if a correct and stable connection between the rigid part and the gaskets is to be guaranteed.

According to a first form, the gaskets are first molded or injected, also possibly obtaining them in a single body, providing the connections which maintain the same components of the gasket in reciprocal position.

The hard plastic that forms the other parts of the valve body is then injected, by means at least of one injection point, so as to obtain a single body in which the two components are integral.

According to a variant, the hard plastic is molded or injected first, and then the soft plastic which forms the one or more gaskets is molded or injected.

According to some embodiments of the invention, the male component and the spring device, advantageously, are integrally associated and made of recyclable plastic material.

According to a variant, the male component and the spring device are made in a single body.

According to another variant, the male component is in a single body with the upper distribution ring.

According to some embodiments, the spring device comprises in a single body the male component of the mobile sealing unit, one or more distribution rings, and one or more springs connected to the one or more distribution rings.

According to some embodiments, the springs can be spiral-shaped, linear zig-zag shaped, or any other shape suitable for the purpose.

According to a variant, the linear zig-zag springs are replaced by helicoidal springs with a small diameter.

According to some embodiments, the springs are independent of each other, that is to say they are not directly connected to one another.

According to some embodiments, the valve assembly can be associated with a closing device, or stopper element, which advantageously but not necessarily, can be screwed onto the upper part of the external container, which clamps into position the various components of the valve assembly in the container itself.

In its normal embodiment, the invention has a single closing element or device, which stably positions the two axial components of the container, and the valve assembly.

The closing device cooperates with the upper part of the valve assembly, and in particular with the upper gasket thereof to guarantee the hermetic seal of the container.

According to a variant of the invention, the valve body is simplified and the application of the sealing element is improved, in addition to improving the seal.

Furthermore, the danger of mold formation is eliminated.

According to the invention, the valve assembly is entirely made of plastic material, that is, all the components of the valve assembly are made of plastic material.

According to a further variant, the plastic materials used in the components of the valve assembly are all in the same class of recyclable material.

According to further variants, there can be a small percentage of plastic materials of different classes, with a negligible weight with respect to the overall weight of the valve assembly and of the beverage container with which it is associated, which has such a small bearing in percentage that it remains in fact irrelevant in the recycling.

BRIEF DESCRIPTION OF THE DRAWINGS

These and other characteristics of the present invention will become apparent from the following description of two solutions, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
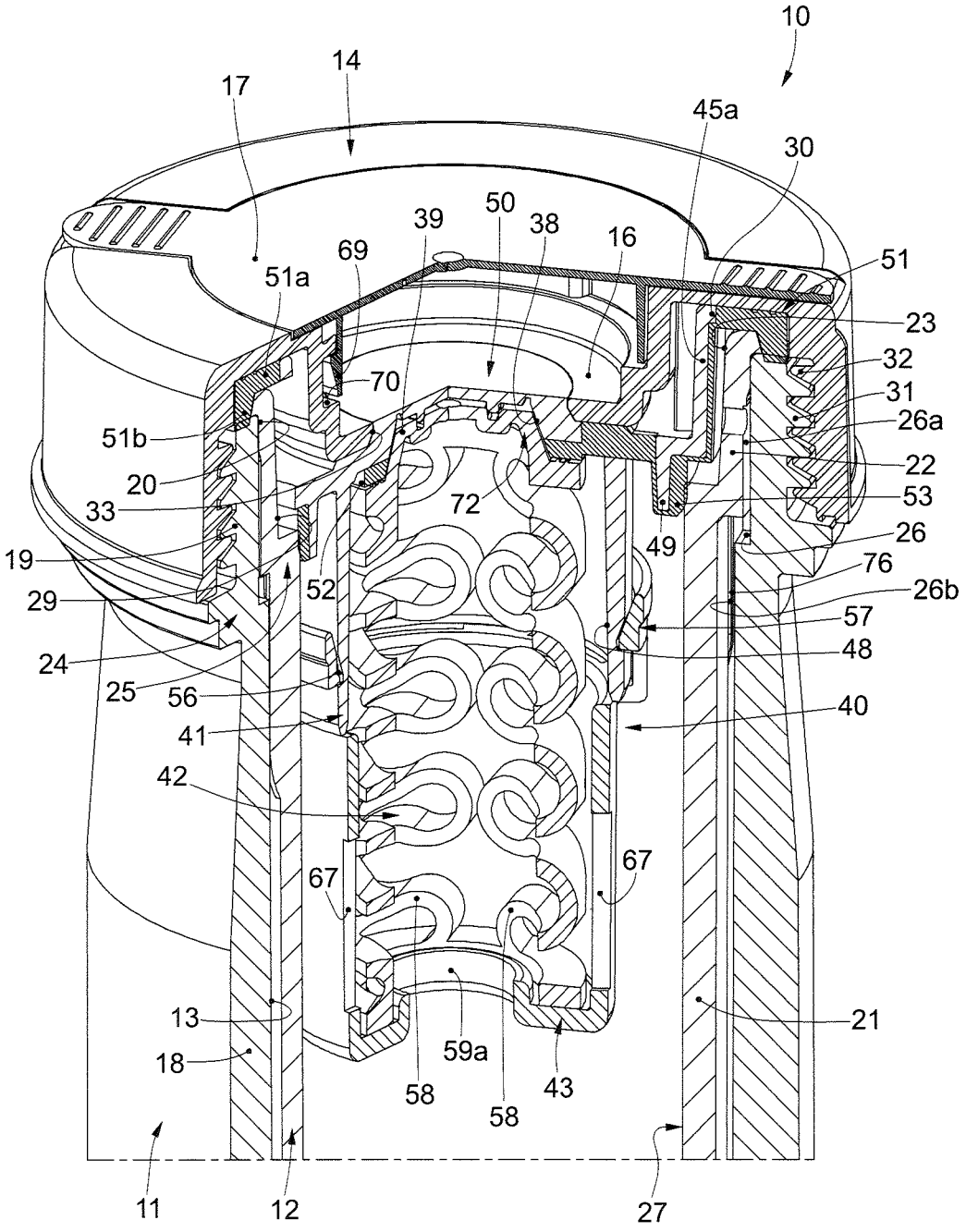
FIG. 1 shows a partially sectioned three-dimensional view of a valve assembly according to embodiments described here in a closed configuration, applied to an assembly of pre-font's suitable to form a container with two components.

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

With reference to the drawings, embodiments described here concern a container 10 for beverages, also referred to in the field as the drum, or keg, which can be obtained by blowing two preforms.

By way of example, the beverage contained can be beer, or another carbonated beverage, such as sparkling wine, or a non-alcoholic beverage, or even a non-carbonated beverage, such as wine or other for example.

The container 10 comprises an external container 11 and an internal container 12, disposed inside the external container 11 and axial to the latter, wherein there is a hollow space 13 between the internal container 12 and the external container 11.

The internal container 12 and the external container 11 are reciprocally positioned in a known manner through the reciprocal collars, or collar portions 19, 22.

A valve assembly 40 and a closing device 14, configured to guarantee both the correct and stable reciprocal positioning of the valve assembly 40 and of the container, and also the hermetic seal of the latter, are associated with the container 10.

According to some embodiments, the closing device 14 comprises a seating 15 for an anti-dirt lid 17, which can be removed at the time of use to allow access to the valve assembly 40 and the installation of suitable dispensing devices, not shown.

These dispensing devices, during use, allow to introduce a pressurized fluid into the hollow space 13, so as to compress the internal container 12 and thus cause the exit of the beverage.

The external container 11 comprises a containing portion 18 and the collar portion 19 provided with a first aperture 20.

The internal container 12 comprises a containing portion 21 and the collar portion 22 provided with a second aperture 23 disposed inside the respective containing portion 18, collar portion 19 and first aperture 22 of the external container 11.

The containing portion 21 defines, during use, a containing compartment 27 for the beverage.

According to some embodiments, the external container 11 and the internal container 12 have respective step-like portions 24, 25 in the respective transition zones between the containing portion 18, 21 and the corresponding collar portion 19, 22, offset with respect to each other, so as to guarantee the presence of the hollow space 13 between the containers 11, 12 even after blowing.

The step-like portions 24, 25 respectively define a distribution channel 26 in which a pressurized fluid can flow and a housing recess 29 suitable to cooperate with the valve assembly 40.

According to some embodiments, the internal container 12 has, in correspondence with the collar portion 22, at least one passage section 28 through which air or pressurized gas can flow from, or toward, the hollow space 13.

According to some embodiments, the passage section 28 is defined by one or more through holes 28.

According to a variant, the passage section 28 is defined by a slit that extends as far as the upper edge of the internal container 12.

According to some embodiments, the internal container 12 also comprises a circumferential support tooth 30 suitable to advantageously rest, during use, on the upper edge of the external container 11, defining a reciprocal axial positioning of the two containers 11, 12.

The external container 11, in this case, has externally a threaded circumferential area 31 into which a threaded portion 32 of the closing device 14 can be screwed and anchored, which holds in reciprocal position the two containers, 11 and 12 and the valve assembly 40.

The closing device 14, according to a variant, has at the upper part and in a known manner, a structure to position the dispensing means and devices necessary to tap the beverage from the internal container 12, possibly overcoming the resistance of a mobile sealing unit 50 of the valve assembly 40 and allowing the passage of the beverage through it.

The closing device 14 is equipped at the upper part and/or inside the seating 15 to stably and without leakages anchor the beverage dispensing device.

According to some embodiments, the seating 15 has an internal annular extension 16 which acts as a base, provided with a central aperture 33 suitable to allow, during use, the transit of the beverage to be dispensed.

According to some embodiments, the seating 15 can be shaped in steps, suitable to define positioning and abutment references for the dispensing devices.

The valve assembly 40, according to some embodiments of the invention, is made in such a way as to allow a suitable dispensing device to introduce pressurized gas, such as air, into the hollow space 13, which by acting between the two containers 11, 12, the internal container 12 being substantially compressible, serves to extract the beverage, and at the same time provide a passage aperture 34 through which the beverage in the internal container 12 can pass in order to reach the dispensing devices.

The valve assembly 40 according to the invention comprises a valve body 41, a spring device 42 and, in the example, a support element 43.

Figure 3:
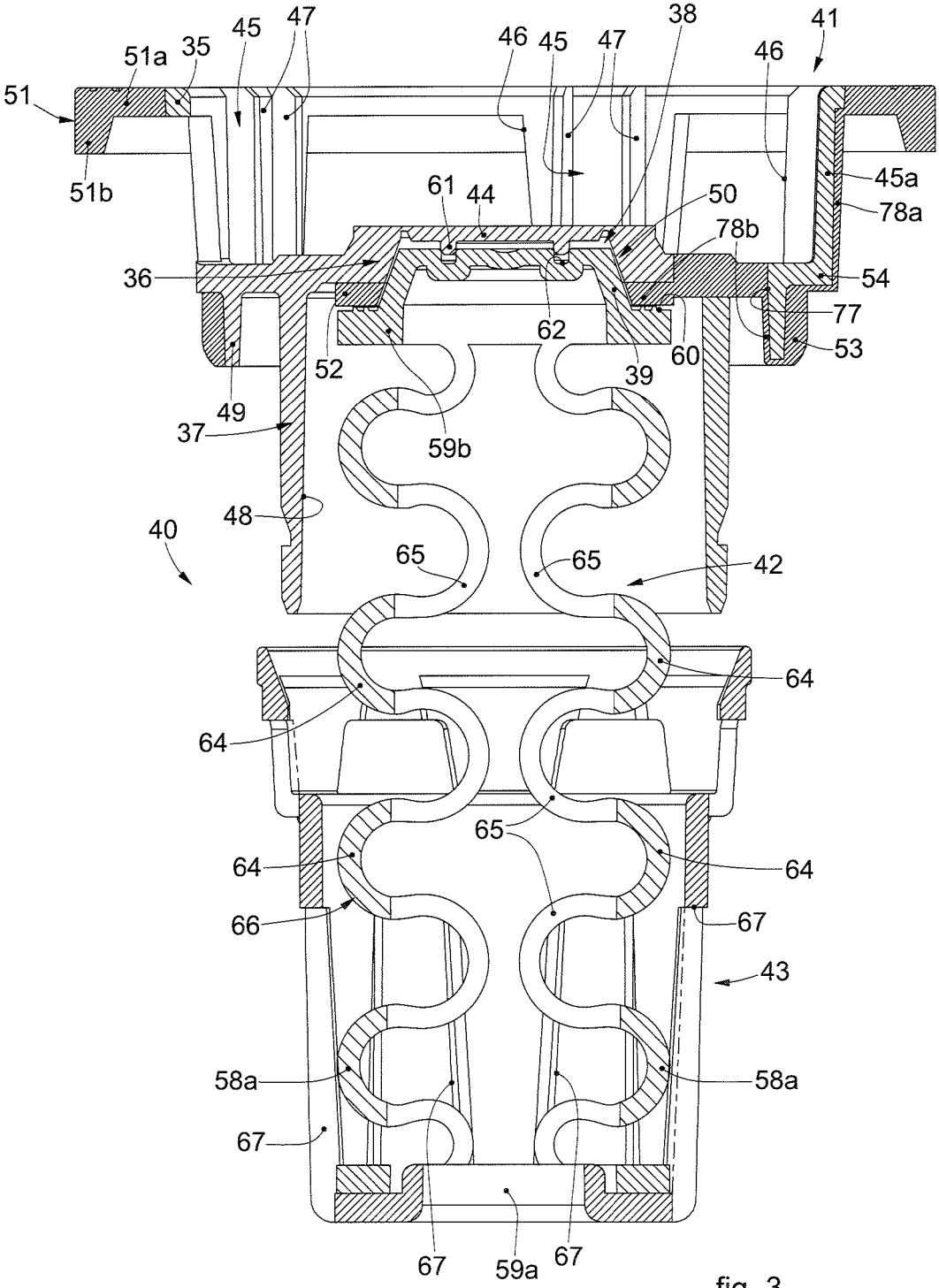
FIG. 3 shows a sectioned front view of a valve assembly according to a variant embodiment.
Figure 4:
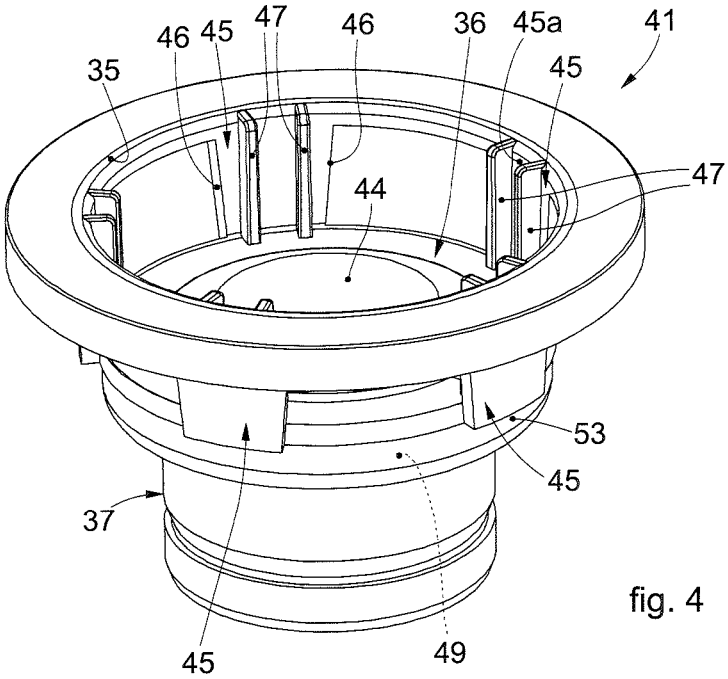
FIG. 4 shows a three-dimensional view of a component of the valve assembly.
Figure 5:
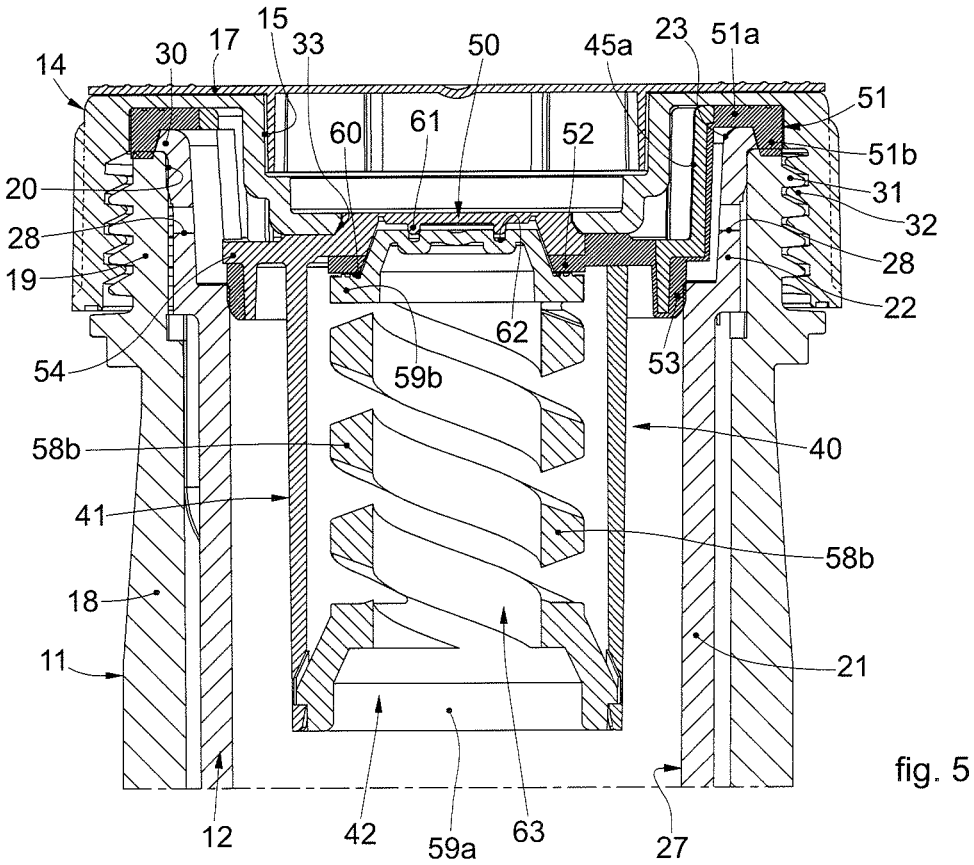
FIG. 5 shows the component of the valve assembly of FIG. 4 in front section.

The valve body 41, as shown for example in FIGS. 3 and 4, is, in this case, made in a single body.

According to some embodiments, the valve body 41 comprises in a single body a rigid plastic material that defines its structure 35, 36, 37, 47, 49 and a flexible plastic material stably associated with the rigid plastic material and defining a plurality of gaskets 51, 52, 53.

According to some embodiments, the valve body 41 comprises an upper annular portion 35, an intermediate equipped wall 36, or plate, and a lower extension 37.

The upper annular portion 35 is connected to the equipped wall 36 by means of one or more connection elements 45.

According to embodiments described with reference to FIGS. 1-5, a plurality of connection elements 45*a* can be provided separated by transit slits 46.

According to embodiments described with reference to FIGS. 1-5, a plurality of connection elements 45*a* can be provided, between the upper annular portion 35 and the intermediate equipped wall 36, which are separated by transit slits 46.

According to some embodiments, the connection elements 45*a* are distanced equally along the circumference of the upper annular portion 35 and of the equipped wall 36.

According to variant embodiments described with reference to FIG. 6, a single connection element 45*b* can be provided, made as a substantially continuous wall on the entire circumferential development.

The connection elements 45 can have ribs or ridges 47 necessary for the connection with the dispensing device.

According to some embodiments, an upper gasket 51, associated with the upper annular portion 35, is provided.

According to possible solutions, the upper gasket 51 has an L-shaped section, with a first segment 51*a* which develops in a radial direction from the upper annular portion 35, and a second segment 51*b* which develops transversely to the first segment 51*a* facing toward the equipped wall 36.

The upper gasket 51 guarantees the hermetic seal of the container with two components 11, 12, being suitable to cooperate with the first segment 51*a* with the upper edge of the internal container 12, and with the second segment 51*b* with the upper edge of the external container 11.

According to some embodiments, the passage aperture 34 is provided, during use, in the equipped wall 36.

According to some embodiments, the lower extension 37 is defined by a tubular-shaped wall which extends from the lower surface of the equipped wall 36 and defines a housing cavity 48 suitable to house at least part of the spring device 42.

The lower extension 37 has a size that is coherent with the requirements of the spring device 42.

According to some embodiments, the valve assembly 40 comprises a mobile sealing unit 50 configured to selectively open and close the passage aperture 34.

According to some embodiments, the mobile sealing unit 50 comprises a female component 38 and a male component 39 at least partially mating in shape and configured to couple with each other to selectively close the passage aperture 34.

According to some embodiments, the equipped wall 36 of the valve body 41 includes the seating, that is, the female component 38, of the mobile sealing unit 50.

According to some embodiments, the male component 39 can be provided on the spring device 42.

In the case shown by way of example, in the initial step, the female component 38 of the mobile sealing unit 50 is closed by a sealing lid 44.

According to some embodiments, the sealing lid 44 is defined by a central portion of the equipped wall 36 with a smaller thickness, configured to be separated from the equipped wall 36 at the first introduction of a beverage dispensing device, so as to define the passage aperture 34 of the valve assembly 40 through which the beverage to be dispensed can pass.

According to some embodiments, the central portion defining the sealing lid 44 is protruding with respect to an upper surface of the equipped wall 36, and recessed with respect to a lower surface, so as to define the female component 38.

According to further embodiments, there is an internal gasket 52, suitable to act as a seal for the mobile sealing unit 50.

According to some embodiments, the internal gasket 52 has an annular shape and is associated with the equipped wall 36 around the passage aperture 34 defined by the female component 38.

According to some embodiments, during use, the internal gasket 52 is interposed between the equipped wall 36 of the valve body 41 and the spring device 42.

According to further embodiments, the valve body 41 comprises an abutment wall 49 with an annular shape which extends from the lower surface of the equipped wall 36, and suitable to cooperate, during use, with the internal surface of the internal container 12.

According to some embodiments, the abutment wall 49 is external and coaxial to the lower extension 37.

An annular cavity 55 can be present between the lower extension 37 and the abutment wall 49.

According to further embodiments, a lateral gasket 53 is provided, suitable to act as a seal between the valve body 41 and the internal container 12 and configured to cooperate with the surface of the containing compartment 27 of the internal container 12.

According to possible solutions, the lateral gasket 53 is associated with the abutment wall 49 and extends over the entire external circumference of the latter so that, during use, it is circumferentially in contact with the internal surface of the internal container 12.

In this way, any leakage of the beverage between the valve body 41 and the internal container 12 is prevented, guaranteeing that the beverage is dispensed only through the passage aperture 34 when it is in the open condition.

According to further embodiments, the valve body 41 comprises a support ring 54 suitable to cooperate, during use, with the housing recess 29 of the internal container 12 and to rest on the step-like portion 25 of the latter, guaranteeing a correct and precise axial positioning of the two components.

According to some embodiments, the support ring 54 is defined by an end portion of the equipped wall 36 protruding beyond the abutment wall 49.

Figure 2:
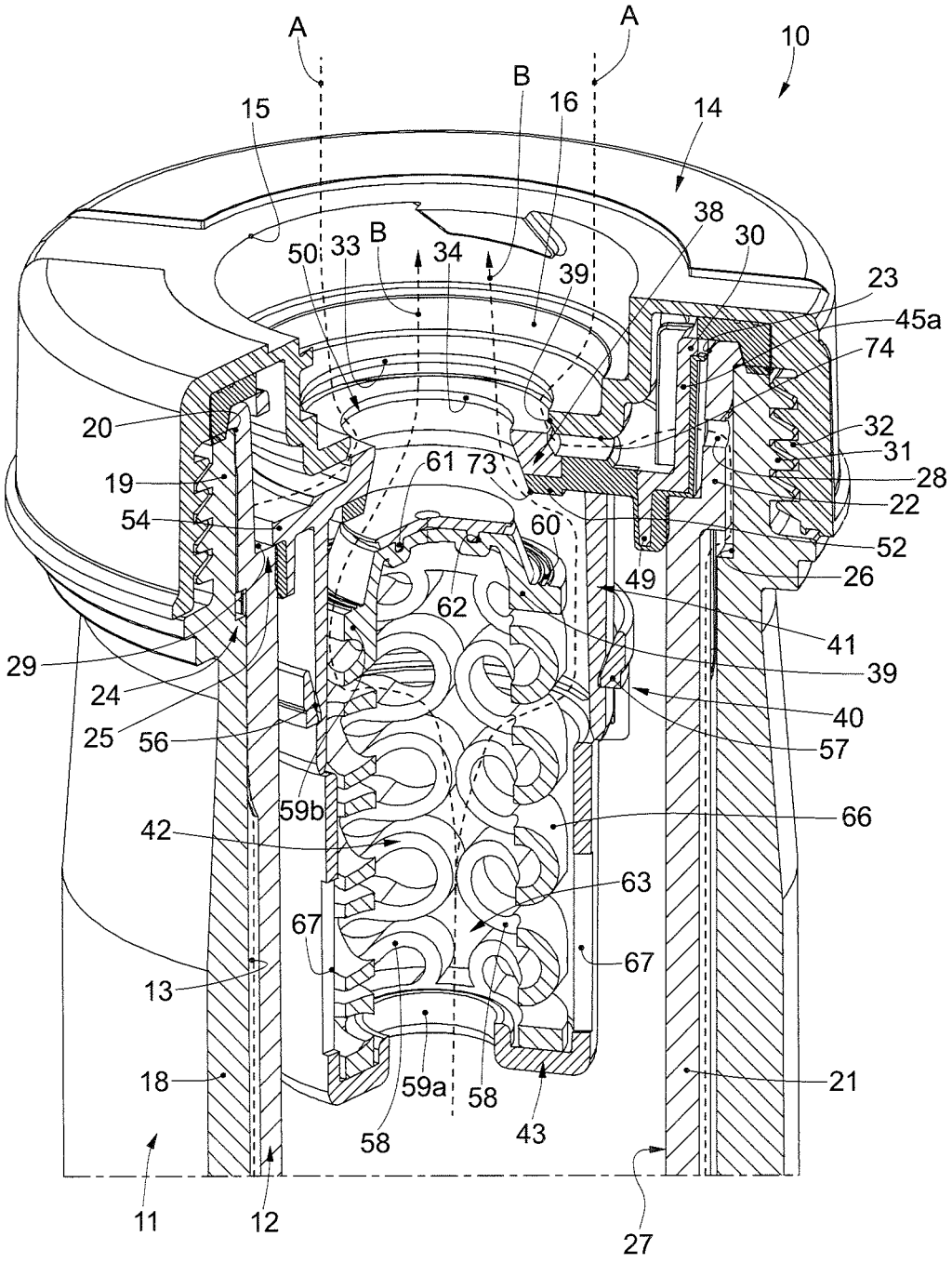
FIG. 2 shows a partially sectioned three-dimensional view of the valve assembly of FIG. 1 in operating mode, after the insertion of a dispensing device.

With reference to FIGS. 1 and 2, the sealing lid 44 has an annular protrusion 61 suitable to be inserted into and coupled with an annular hollow 62 present on the male component 39 of the mobile sealing unit 50, and this attachment occurs when a dispensing device is introduced for the first time.

In this way, when the dispensing device presses the sealing lid 44 and separates it from the equipped wall 36, it anchors itself to the spring device 42, becoming part of the male component 39.

When the dispensing device is removed, the elastic compression force of the spring device 42 will tend to extend the latter, bringing the male component 39 and therefore the sealing lid 44 connected thereto to couple with the female component 38 and the equipped wall 36 so as to close the passage aperture 34.

According to some embodiments, the valve body 41, can be made by injection over-molding of the soft material onto the rigid material.

According to some embodiments, the gaskets 51, 52, 53 have connecting flaps 78*a*, 78*b* which join them one to the other, all being obtained with a single injection point.

According to these embodiments, the equipped wall 36 made with the rigid material can be provided with a passage slit 77 suitable to allow the soft material to pass through it, in order to make the internal gasket 52.

According to variant embodiments, the gaskets 51, 52, 53 are separated from one another. In this case, it can be provided that they are made independently of one another, for example by means of injection over-molding on the respective parts of the valve body 41, with which they are associated.

According to this embodiment, the passage slit 77 is therefore filled with the soft material.

According to embodiments that provide the valve assembly 40 consisting of three components, shown for example in FIG. 3, the valve body 41 and the support element 43 can be coupled together by means of mating coupling members 56, 57.

According to some embodiments, the coupling members 56, 57 can comprise, for example, a female annular hollow 56 provided on the valve body 41 and a male annular attachment 57 provided on the support element 43.

According to some embodiments, the spring device 42 in this specific case has in a single body one or more springs 58 and at least one distribution ring 59*a*, 59*b*.

According to some embodiments, for example described with reference to FIG. 3, the spring device 42 comprises a lower distribution ring 59*a* and an upper distribution ring 59*b*.

The upper distribution ring 59*b*, in this specific case, has an annular ledge 60 from which, by way of example, the male component 39 of the mobile sealing unit 50, associated with the spring device 42, originates.

The springs 58 can be helicoidal 58*b*, FIG. 4, or linear zig-zag-shaped 58*a*, FIGS. 1-2, having a conformation suitable to generate the desired thrust for the necessary time.

It should be noted that the helicoidal springs 58*b*, due to their conformation, do not exert a uniform pressure on the support circumference of the spring device 42, between the male component 39 and the female component 38, but are affected by the position where the helix ends.

To overcome this disadvantage, according to a variant of the invention, linear zig-zag springs 58*b* are used in a number and conformations suitable to generate the desired thrust, guaranteeing the necessary axial travel of the male component 39 of the spring device 42.

According to some embodiments, the zig-zag spring elements 58*a* are connected to both the distribution rings 59*a*, 59*b* in correspondence with their ends.

According to some embodiments, the zig-zag spring elements 58*a* are independent of each other, that is to say they are not directly connected to one another but only to the distribution rings 59*a*, 59*b*. This allows to obtain a better load distribution and greater seal and duration of the spring device 42.

According to some embodiments, the zones connecting the zigzag springs 58*a* and the distribution rings 59*a*, 59*b* are substantially aligned with each other along the respective circumferences of the lower 59*a* and upper 59*b* distribution ring, that is, overlapping along respective vertical axes.

According to some embodiments, the distribution rings 59*a* and 59*b* lie on respective planes parallel to each other and orthogonal to the longitudinal axis X.

According to some embodiments, the spring device 42 comprises an upper portion 72 suitable to act as a shutter element for a valve assembly 40.

According to some embodiments, the upper portion 72 has a truncated cone shape, and defines the male component 39 of the mobile sealing unit 50.

According to some embodiments, the upper portion 72 is associated with the upper distribution ring 59*b*.

According to some embodiments, the upper distribution ring 59*b*, on the surface facing, during use, toward the outside, has at least one rib 75 which develops circumferentially.

According to some embodiments, two or more circumferential ribs 75 can be provided, possibly concentric to each other.

According to some embodiments, the ribs 75 can cooperate with the internal gasket 52 of the valve body 41 in order to guarantee a sealed coupling of the two components.

The spring device 42 is in particular sized so as to maintain a thrust approximate to a minimum value permitted during the maximum time expected to be necessary for storage, transport, storage in the user's warehouse and tapping.

According to some embodiments, the zig-zag springs 58*a* can be conformed with different geometries, so that it is possible to have undulations, linear zig-zag shapes, arcuate zig-zag shapes, consecutive waves with positive and/or negative developments, or a combination thereof.

According to possible solutions, for example shown in FIGS. 1 and 2, the spring device 42 has a circular section, that is, it comes within a cylinder with a diameter between 25 and 35 mm, advantageously around 30 mm, but it can also have other compatible sizes according to the application of the spring device 42.

According to some embodiments, the zig-zag springs 58*a* that define the spring device 42 are advantageously conformed so as to remain inside a cylindrical ring, the sizes of which are defined by the lower 59*a* and upper 59*b* distribution rings.

According to these embodiments, the spring device 42 comprises an internal compartment 63 substantially cylindrical in shape through which, during use, the beverage to be dispensed can pass.

According to some embodiments, the zig-zag springs 58*a* can have a constant thickness along their longitudinal development.

According to some embodiments, the zig-zag springs 58*a* have a profile with a plurality of crests 64 and troughs 65, defining respective alternating convexities and concavities, located in succession one after the other.

According to some embodiments, the crests 64 and the troughs 65 extend on the two sides with respect to a longitudinal center line M of the zig-zag springs 58*a*.

According to embodiments described with reference to FIG. 3, the zig-zag springs 58*a* have a wave-shaped conformation defined by consecutive circumferences, that is, the crests 64 and the troughs 65 are defined by substantially circular-shaped portions located in succession one after the other.

According to embodiments described for example with reference to FIGS. 1-3, there are four zigzag springs 58*a* that make up the spring device 42, opposite each other two by two.

According to these embodiments, the zig-zag springs 58*a* are connected in pairs in correspondence with the respective adjacent crests 64 by means of external connection bridges 66 which also fulfill the condition of single external wave.

According to further embodiments, the valve body 41 and/or the support element 43 advantageously have transit slits 46, 67 able to let disinfectant cleaning factors enter, both in the case of FIGS. 1 and 2, and also in the case of FIG. 3 in which the valve body 41 is in a single piece with the support body 43.

According to some embodiments, the transit slits 67 can be made in a longitudinal direction in the lateral wall of the support element 43, so as to make the internal surface of the support element 43 accessible, and allow it to be cleaned and sanitized, for example by means of UV rays, infrared rays, washing fluids, or other.

Depending on which variant is considered, the spring device 42 will rest on the bottom of the support element 43 (FIGS. 1, 2 and 3), or it will be anchored circumferentially, or otherwise, in an attachment element 68 of the valve body 41, FIG. 4.

According to some embodiments, the valve assembly 40 is completely, or almost completely, made of recyclable plastic material, preferably of the same class as the plastic material with which the containers 11, 12 are made, so that the final container, or keg, can be disposed of and recycled without needing to remove one or more components. A minimum percentage of plastic materials of a different class can possibly be present, however, providing that this percentage is less than the limits required by legislation for the recycling of plastic materials, for example less than 5%, or also 3%, and that the remaining 95%, or also 97% by weight is of recyclable plastic material.

According to some embodiments, the containers 11, 12, the valve assembly 40 and the closing device 14 are made of polyethylene terephthalate (PET).

The functioning of the valve assembly 40 according to the invention is described below.

The valve assembly 40 is inserted in the internal container 12 of a container 10, or keg, with two components, in assembled form, that is, with the spring device 42 integrally coupled to the valve body 41 and to the possible support element 43.

In particular, the valve assembly 40 is inserted in such a way that the upper gasket 51 is located in contact with the respective upper edges both of the internal container 12 and also the external container 11, guaranteeing at the upper part the hermetic seal of the hollow space 13 and guaranteeing the reciprocal coupling of the containers 11, 12.

In the initial insertion position (FIG. 1), the valve body 41 positions itself with its support ring 54 suspended with respect to the housing recess 29 of the internal container 12, therefore the lateral gasket 53 is in contact with the internal surface of the internal container 12 only with a lower portion thereof.

To guarantee the cleaning of the loading and dispensing area, the closing device 14, which has the seating 15 suitable to house the anti-dirt lid 17, which is provisionally attached thanks to male attachment means 69 which couple with female attachment means 70 present in the closing device 14, is screwed onto the container or keg 10.

Once screwed onto the threaded circumferential area 31, the closing device 14 stably positions the valve assembly 40, acting on the upper gasket 53 of the valve body 41, guaranteeing the seal between the two containers 11, 12.

This means that the internal annular extension 16 of the closing device 14 rests on the upper surface of the equipped wall 36 of the valve body 41, and stably positions the female component 38, which can therefore couple correctly with the male component 39 forming the mobile sealing unit 50.

In this case, the valve body 41 has the internal gasket 52 around the female component 38, which, when the valve assembly 40 is in the closed position, cooperates with the upper distribution ring 59*a* of the spring device 42 to guarantee the hermetic seal of the passage aperture 34 preventing the beverage from exiting.

Therefore, the valve assembly 40 has a double seal, both a mechanical seal 38-39 of the mobile sealing unit 50, and also a flexible seal provided by the internal gasket 52.

The valve assembly 40 and the closing device 14 are preferably associated with the container 10 after it has first been filled with the beverage.

By applying a beverage dispensing device for the first time in the specific seating 15 present in the closing device 14, the sealing lid 44 is pushed downward, breaking a predefined breaking line 71, in this case circumferential.

The sealing lid 44 is then pushed toward the upper portion 72 of the spring device 42, compressing the springs 58*a*, 58*b* and moving the upper portion away from the equipped wall 36, so as to open the passage aperture 34.

The displacement of the sealing lid 44 and the compression of the spring device 42 entails the generation of a dispensing channel 73 through which the beverage can be dispensed.

The annular protrusion 61 of the sealing lid 44 then positions itself in the annular hollow 62 present in the upper portion 72 of the spring device 42, creating a whole 44-72, which, together with the female component 38 provided in the equipped wall 36, forms the mobile sealing unit 50.

According to some embodiments, not shown, there can be radial grooves on at least one of either the internal annular extension 16 or the equipped wall 36, suitable to allow the passage of air or gas toward the transit slits 46 and the passage sections 28. This solution, however, does not guarantee an accurate protection against dust and dirt that can enter the closing device 14.

According to preferred embodiments, the internal annular extension 16 and the equipped wall 36 are mating in shape, suitable to define a mechanical seal when located reciprocally in abutment.

According to some embodiments, the action of the dispensing device causes the valve body 41 to be pushed downward, until the support ring 54 abuts against the step-like portion 25, and is inserted into the housing recess 29 and the lateral gasket 53 comes into full contact with the internal surface of the internal container 12.

According to this embodiment, the upper annular portion 35 separates from the upper gasket 51, which remains compressed between the closing device 14 and the upper edges of the two containers 11, 12, guaranteeing their hermetic seal.

The downward movement of the valve body 41 causes a passage channel 74 to be defined between the internal annular extension 16 of the closing device 14 and the equipped wall 36, through which a pressurized fluid, for example air, introduced by the dispensing devices, can flow.

The pressurized fluid enters the passage channel 74 and transits through the transit slits 46 of the valve body 41 and the passage sections 28 provided on the internal container 12 to reach the hollow space 13 and compress the internal container 12. By way of example, the arrows A in FIG. 2 indicate the path of the pressurized fluid.

The beverage then transits through the internal compartment 63 of the spring device 42, and through the springs 58*a*, 58*b* to reach the housing cavity 48 of the valve body 41 and from there it passes through the dispensing channel 74 and the passage aperture 34 to reach the dispensing device. By way of example, the arrows B in FIG. 2 indicate the path of the beverage.

When the dispensing device is removed, the spring device 42, no longer subjected to compression, expands, bringing the male component 39 to couple with the female component 38 of the mobile sealing unit 50, and the sealing lid 44 substantially returns to its initial position, closing the passage aperture 34.

The valve assembly 40, therefore, is driven to close by the spring device 42 which operates axially and inside the lower extension 37 of the valve body 41 and possibly of the support element 43.

The excess air or gas, present in the hollow space 13 between the two containers 11, 12, transits through the annular distribution channel 26 to reach the passage sections 28 and from there, through the transit slits 46 and passage channel 74, it is discharged to the outside.

There can also be one or more axial channels 26*a* in the hollow space 13, defined by a recess made below the through holes, and one or more axial channels 26*b* defined by ridges 76 provided on one of either the external container 11 or the internal container 12.

According to the variant described with reference to FIGS. 6 and 7, a solution is described which, as well as simplifying the valve body 141, allows to eliminate any danger of beer stagnating and therefore the formation of mold.

In addition to this, the valve assembly 40 is improved, simplifying it, and the hydraulic seal is improved.

The application of the beverage dispensing device is also improved.

Figure 6:
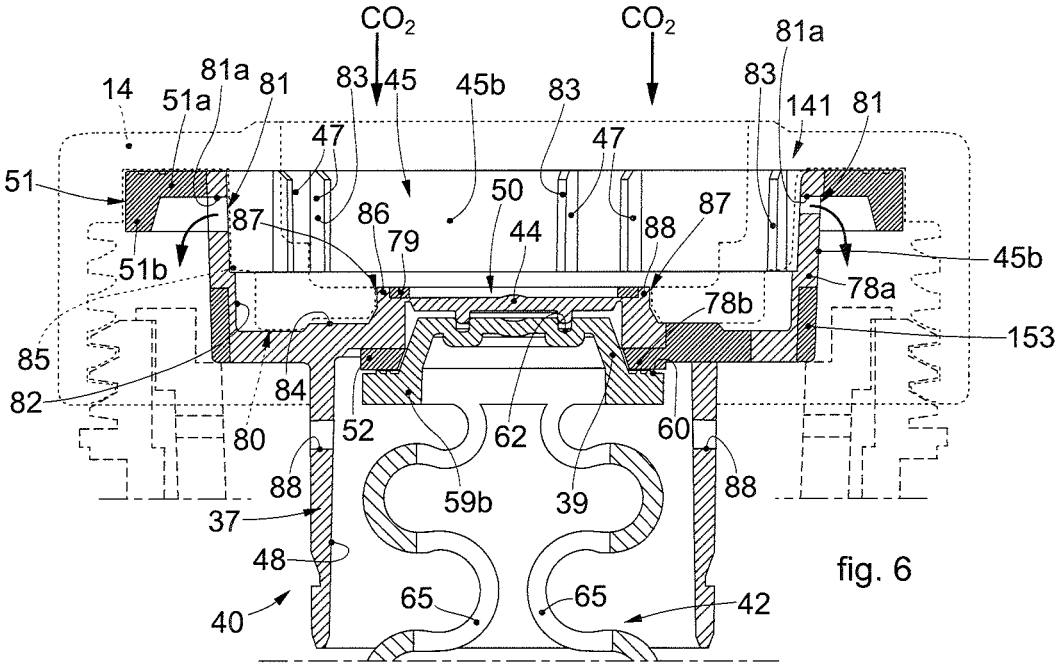
FIG. 6 shows a sectioned front view of a part of the valve assembly according to another variant embodiment.
Figure 7:
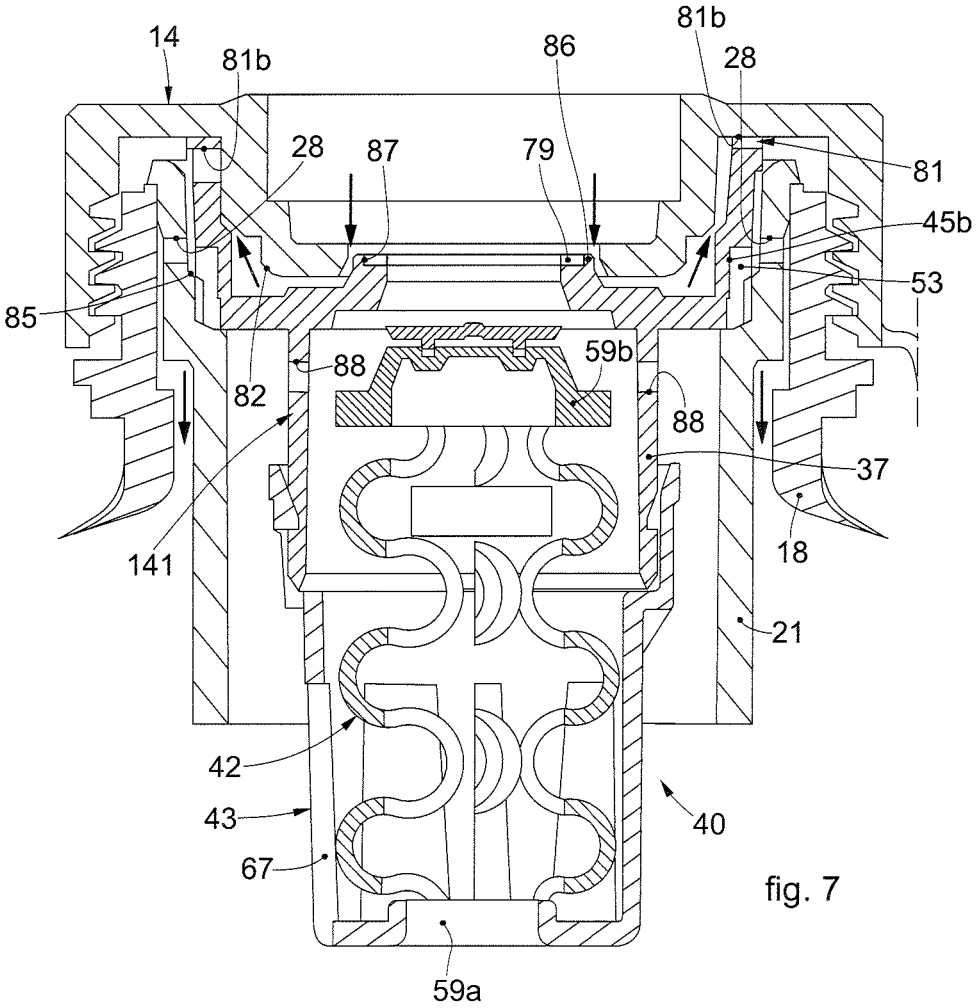
FIG. 7 shows a sectioned front view of the part of FIG. 6 during tapping operations.

The valve body 141 according to the variant shown in FIGS. 6 and 7 also comprises in a single body a rigid plastic material which defines its structure 35, 36, 37, 47 and a flexible plastic material stably associated with the rigid material and defining a plurality of gaskets 51, 52, 53.

In the valve body 141 in FIGS. 6 and 7 the upper annular portion 35 is connected to the equipped wall 36 by means of a connection element 45 in the form of a substantially continuous annular wall 45*b*. In this embodiment, the transit slits 46 are eliminated.

Furthermore, according to some embodiments the connection wall 45*b* is provided with ribs or ridges 47 which extend toward the inside, which on one side can allow the connection with the dispensing device, and on the other side define in pairs a vent channel 83 for the gas.

According to some embodiments, to allow the transit of carbon dioxide toward the hollow space 13, the valve body 141 comprises at least one passage channel for the gas 81 which puts an internal side in communication with an external side of the valve body 141.

According to embodiments described with reference to FIG. 6, the passage channel 81 is defined by a vent hole 81*a* made in the connection wall 45*b* in proximity with the upper annular portion 35. According to other embodiments, one or more vent holes 81*a* distanced from each other can be present.

According to other embodiments, described with reference to FIG. 7, the passage channel 81 can be defined by at least one groove 81*b* made in the upper annular portion 35, which extends radially with respect to a longitudinal axis of the valve body 141.

According to other embodiments, one or more holes 81*a* and/or one or more grooves 81*b* can be present.

Providing the hole 81*a* and/or the grooves 81*b* in correspondence with an upper portion of the valve body 141 is advantageous to stop the beverage leaking through them, when the container 10 filled with the beverage is closed. In this way the risk of possible stagnations of beverage, which could otherwise accumulate in a compartment 82 between the closing device 14 and the equipped wall 36 and generate mold, is reduced, if not eliminated.

According to further embodiments, the valve body 141 comprises one or more radial hollows 84 made in the thickness of the equipped wall 36, suitable to channel, during use, the gas injected into the valve body 141 to make it pass from the compartment 82 toward the passage channel or channels 81.

Furthermore, the lower abutment wall 49 has been eliminated in the valve body 141, improving the seal of the lateral gasket 53 which, in this case, extends substantially over the entire lower circumferential portion of the connection wall 45*b*.

During use, the closing device 14 is positioned in a stable manner with a lower circumferential portion 80 thereof on an annular positioning edge 85 provided on the connection wall 45*b*.

The annular edge 85 defines a step in the connection wall 45*b*, reducing its internal diameter.

According to some embodiments, there is a sealing gasket 79 around the central portion of the equipped wall 36 which defines the sealing lid 44, configured to isolate, during use, the carbon dioxide circuit from the beverage circuit, improving the seal of the valve body 141.

According to further embodiments, the equipped wall 36 can comprise a protruding annular ridge 86 which surrounds the central portion defining the sealing lid 44 and the sealing gasket 79 which defines, together with the base portion 80 of the closing lid 14, a passage gap 87 for the gas toward the compartment 82.

Thanks to this modification, during the closing of the container 10 with the closing device 14, carbon dioxide ($CO_2$) can be injected into the valve body 141 inserted in the internal container 12, making it pass through the passage gap 87 and through the radial hollows 84 and vent channels 83, as far as the passage channel/channels 81, substantially cleaning the compartment 82 from possible beverage residues.

Furthermore, the injected carbon dioxide passing through the passage channels 81 can reach the inside of the container 10, filling the head space above the beverage.

According to further embodiments, the valve body 41, 141 also comprises one or more transit holes 88 made through in the lower extension 37 in proximity to the zone where the lower extension 37 and the equipped wall 36 connect.

Thanks to these transit holes 88, when a dispensing device is inserted in cooperation with the valve device 40, it is possible to very quickly remove the carbon dioxide present in the head space.

Furthermore, these transit holes 88 also facilitate the exit of the air when the internal container 12 is almost completely collapsed.

Embodiments described here also concern a method to fill and close a container 10 for beverages comprising an external container 11 and an internal container 12 which provides to:

- fill the internal container 12 with the beverage;
- position the valve assembly 40 already assembled in the internal container 12 with the valve body 41, 141 located in contact at the upper part with an upper edge of the external container 11;
- apply the closing device 14 over the valve assembly 40 and screw it onto the external container 11.

According to some embodiments, the method provides to inject a flow of pressurized carbon dioxide toward an upper surface of the container 10 during the positioning of the valve assembly 40, and to apply and screw the closing device 14.

According to some embodiments, the method provides in particular to start injecting a flow of pressurized carbon dioxide toward the container 10 as soon as the step of filling with the beverage has ended, and to stop injecting only when the closing device 14 has been completely screwed on the external container 11.

The flow of carbon dioxide, following the path described above, and indicated with the arrows in FIG. 6, can therefore remove possible beverage residues from the compartment 82, which could otherwise generate mold.

According to some embodiments, in the step of screwing the closing device 14 the method provides to apply a torque comprised between 45N and 55N.

It is clear that modifications and/or additions of parts may be made to the valve assembly 40 as described heretofore, without departing from the field and scope of the present invention.

It is also clear that, although the present invention has been described with reference to some specific examples, a person of skill in the art shall certainly be able to achieve many other equivalent foul's of valve assembly 40, having the characteristics as set forth in the claims and hence all coming within the field of protection defined thereby.

The invention claimed is:

1. Valve assembly for a beverages container with two components, of which one external container and one internal container, closed at the upper part by a closing device, wherein said valve assembly comprises a valve body made in a single body and a spring device, a mobile sealing unit being present between said valve body and said spring device, configured to selectively open and close a passage aperture of said valve assembly, wherein said valve assembly is made of recyclable plastic material in direct union with said containers of the beverage container, wherein said valve body comprises in a single body a rigid material that defines a structure thereof and a soft material stably associated with the rigid material that defines one or more sealing gaskets, wherein said structure comprises an upper annular portion, an equipped wall connected to the upper annular portion by at least one connection element, a lower extension defining a housing cavity for said spring device, wherein said at least one connection element comprises at least one transit slit or one passage channel for a gas.

2. Valve assembly as in claim 1, wherein said valve body has an upper gasket stably associated with it and suitable to cooperate, during use, with the closing device of the container on one side and with the upper edge of the two concentric containers on the other.

3. Valve assembly as in claim 1, wherein said valve body has a lateral gasket stably associated with it and suitable to cooperate, during use, with an internal circumference of the internal container.

4. Valve assembly as in claim 1, wherein said valve body has an annular, internal gasket integrative with the valve assembly and suitable to cooperate, during use, with the spring device.

5. Valve assembly as in claim 1, wherein said valve body has an annular sealing gasket integrative with the valve assembly suitable to cooperate, during use, with a beverage dispensing device.

6. Valve assembly as in claim 1, wherein said valve body comprises one or more radial hollows made in the thickness of the equipped wall.

7. Valve assembly as in claim 1, wherein the valve body has a lower extension cooperating with elastic means of the spring device acting on a component of the mobile sealing unit for the correct positioning of said valve assembly.

8. Beverages container of the keg type provided with an external container, an internal container and a closing device, wherein the beverages container comprises a valve assembly as in claim 7, wherein said external container, said internal container, said closing device and said valve assembly are made, at least for a percentage higher than 97% of the overall weight of the container, of a same recyclable plastic material.

9. Valve assembly as in claim 1, wherein said mobile sealing unit is configured to cooperate with an internal annular extension present in said closing device to define a correct reciprocal positioning of said spring device and said valve body, said spring device is connected with a male component of the mobile sealing unit, and said valve body is connected with a female component of the mobile sealing unit.

10. Valve assembly as in claim 1, wherein said spring device comprises at least a load distribution ring and at least two linear zig-zag springs stably connected to said at least one distribution ring.

11. Valve assembly as in claim 1, wherein said equipped wall is made of said rigid material and comprises a passage slit filled with said soft material, wherein said one or more gaskets have flaps connecting with each other, being made by means of over-injection molding on the structure of rigid material with a single injection point.

12. Valve assembly as in claim 1, further comprising a support element coupled with said valve body and configured to define containing and support means for said spring device.

13. Valve assembly as in claim 12, wherein said support element comprises transit slits made along a longitudinal direction in the lateral wall thereof, and configured to allow the access to the internal surface of said support element to allow it to be cleaned and disinfected by means of UV-rays, infrared rays, washing fluids, or other.

14. Valve assembly for a beverages container with two components, of which one external container and one internal container, closed at the upper part by a closing device, wherein said valve assembly comprises a valve body made in a single body and a spring device, a mobile sealing unit being present between said valve body and said spring device, configured to selectively open and close a passage aperture of said valve assembly, wherein said valve assembly is made of recyclable plastic material in direct union with said containers of the beverage container, wherein the valve body has a female component of said mobile sealing unit, wherein said female component of the mobile sealing unit temporarily has a sealing lid, wherein said sealing lid and a male component of the mobile sealing unit are provided with respective annular hollows and protrusions suitable to define a reciprocal coupling.

15. Valve assembly as in claim 10, wherein said linear zig-zag springs cooperate with a male component of said mobile sealing unit associated therewith.

16. Valve assembly as in claim 14, wherein said spring device comprises at least a load distribution ring and at least two linear zig-zag springs stably connected to said at least one distribution ring.

17. Valve assembly as in claim 16, wherein said linear zig-zag springs cooperate with the male component of said mobile sealing unit associated therewith.

18. Valve assembly as in claim 14, wherein said valve body comprises in a single body in a rigid material that defines the structure thereof and a soft material stably associated with the rigid material that defines one or more sealing gaskets, said equipped wall is made of said rigid material and comprises a passage slit filled with said soft material, wherein said one or more gaskets have flaps connecting with each other, being made by means of over-injection molding on the structure of rigid material with a single injection point.

19. Valve assembly as in claim 14, further comprising a support element coupled with said valve body and configured to define containing and support means for said spring device.

20. Valve assembly as in claim 19, wherein said support element comprises transit slits made along a longitudinal direction in the lateral wall thereof, and configured to allow the access to the internal surface of said support element to allow it to be cleaned and disinfected by means of UV-rays, infrared rays, washing fluids, or other.

* * * * *